United States Patent [19]

DeBose

[11] 4,310,927

[45] Jan. 19, 1982

[54] MUSCLE MAN SHIRT

[76] Inventor: Alfred C. DeBose, 7835 Grow La., #1013, Houston, Tex. 77040

[21] Appl. No.: 156,065

[22] Filed: May 30, 1980

[51] Int. Cl.[3] ..... A41B 1/00

[52] U.S. Cl. ..... 2/115; 46/2; 2/DIG. 3

[58] Field of Search ..... 2/115, DIG. 10, 2.1 R, 2/DIG. 3, 108; 46/2

[56] References Cited

U.S. PATENT DOCUMENTS 4,089,065 5/1978 McGee ..... 2/DIG. 3

4,220,299 9/1980 Motter ..... 2/2.1 A

FOREIGN PATENT DOCUMENTS 675750 8/1966 Canada ..... 2/2.1

*Primary Examiner*—Doris L. Troutman

[57] ABSTRACT

This shirt is to be worn by children, and it consists primarily of inflatable chest muscle portions, inflatable stomach muscle portions, and inflatable biceps portions in the arms. It further includes an elastic neck band and elastic wrist bands, for securing it to the child, when it is being inflated, and it also includes an optional cape, that may be snapped on, or adhesively secured to the shoulder portions.

2 Claims, 2 Drawing Figures

MUSCLE MAN SHIRT

This invention relates to toys, and more particularly, to a muscle man shirt.

It is, therefore, the principal object of this invention to provide a muscle man shirt, which will be novel and unique, and will be worn by children.

Another object of this invention is to provide a muscle man shirt, which will be inflatable in certain portions, so as to enable a child to pretend that he is a muscle man.

Another object of this invention is to provide a muscle man shirt, which will be inflatable by a child, wherein he can watch the muscle portions grow in size, so as to enable him to imagine that he is a form of a cartoon hero, or body builder, and a child can also use his imagination, to create character stories, games, etc.

A further object of this invention is to provide a muscle man shirt, which will include a snap-on, or adhesive cape, so as to enable a child to pretend he is a superhero.

Other objects of the present invention are to provide a muscle man shirt, which is simple in design, inexpensive to manufacture, rugged in construction, easy to use and efficient in operation.

Figure 1:
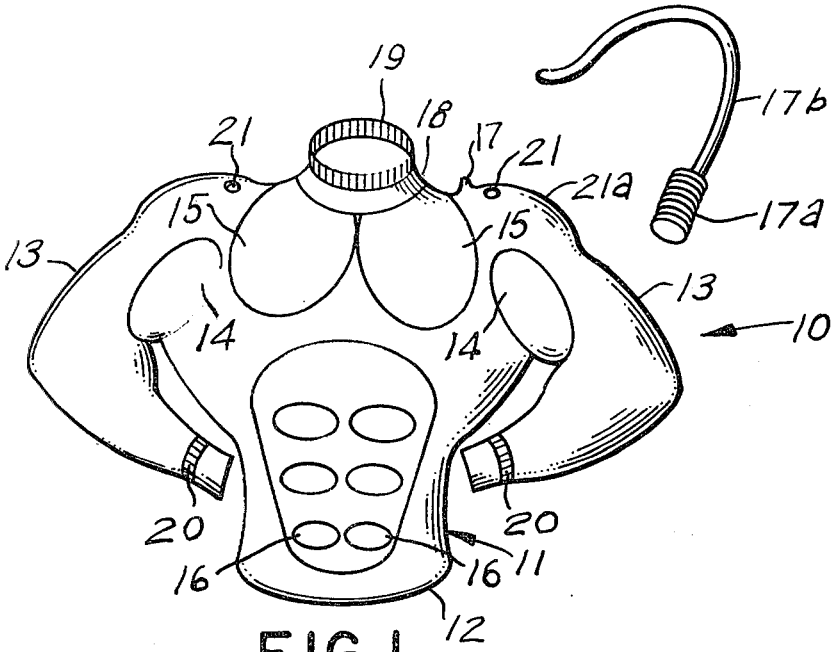
Figure 2:
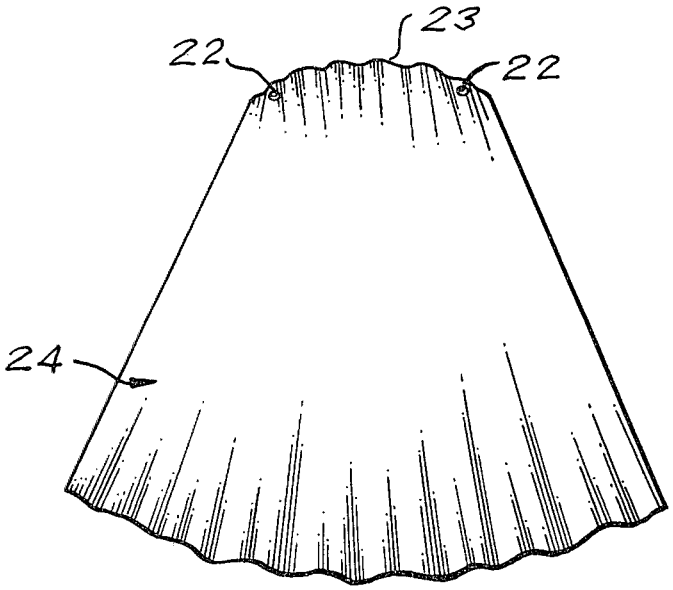

These, and other objects, will be readily evident upon a study of the following specification and the accompanying drawing wherein:

FIG. 1 is a perspective view of the present invention, which also illustrates an air pump for the inflation thereof, and FIG. 2 is a plan view of a cape, for attachment to the structure of FIG. 1.

According to this invention, a shirt 10 is shown to include a hollow main body 11, having a circular tail 12 portion, which will fit a child's waist. The arms 13, extending from the sides, include inflatable biceps portions 14, and a pair of front chest portions 15 are inflatable. Also, in the front, are a plurality of spaced-apart and inflatable stomach portions 16. A valve 17, in the neck portion 18, is provided for the inflation, through the use of a manually operated air pump 17*a*.

An elastic collar band 19 is fixedly secured, in a suitable manner, to the top of neck portion 18, and a similar wrist band 20 is fixedly secured to each of the arms 13.

A snap fastener 21 is fixedly secured in the shoulders 21*a*, so as to engage with the pair of spaced-apart fasteners 22, in the upper portion 23 of tapered cape 24.

It shall be noted, that cape 24 is optional, and fasteners 21 and 22 may be substituted for, by a suitable adhesive means.

In use, a child puts shirt 10 on, in the same manner as he would a sweater, or the like. He then uses the hand pump 17*a* to inflate shirt 10, by placing the tube 17*b* on the valve 17, and all of the portions 14, 15 and 16 will inflate simultaneously. Accordingly, all the inflatable areas in the chest, bicep and stomach portions communicate with the single valve, for such simultaneous inflation. When shirt 10 is inflating, the elastic bands 19 and 20 will serve as a means to secure shirt 10 on the child's body.

A modified form of shirt, (not shown) can be fabricated of thin tearable material, which, when the child takes a deep breath, will tear in the chest area, and produce a ripping sound, and when the child lifts his arms and contracts his biceps, they will tear, producing a ripping sound. This will also make a child believe he is a super hero, or body builder. Several of the abovementioned shirts must be put into one package, because they are disposable after use.

Another modified form of shirt, (not shown) can be produced with snap-ons. This type would thus be nondisposable. The snap-ons of this style will be plastic, and sensitive to the slightest pressure, and thus, if the child flexes his biceps, the plastic snap-ons will snap off, producing a ripping sound. Afterwards, the child can resnap the plastic, and do it all over again. The plastic snap-ons can be positioned on the biceps, under the arms, and on the chest area.

It shall also be recognized, that shirt 10 is adaptable as a float, for use in water, so as to enable a child to be supported.

While various changes may be made in the detail construction, it is understood that such changes will be within the spirit and scope of the present invention, as is defined by the appended claims.

What I now claim is:

1. A muscle enlarging shirt, comprising, in combination, a hollow main body, a circular tail portion for fitting a child's waist, a pair of arm portions secured to said hollow main body, a pair of inflatable bicep portions, a pair of chest portions, a plurality of stomach portions secured to said hollow main body, and a cape removably secured to said hollow main body; said pair of inflatable chest portions being adjacent to each other, and fixedly secured to said hollow main body, below a neck portion thereof, and a flexible band is fixedly secured to the top of said neck portion, for securing said shirt to a child's body, when inflation takes place, and said pair of arm portions are fixedly secured to shoulder portions of said hollow main body, said pair of inflatable bicep portions are each fixedly secured to one of said arm portions, said pair of arm portions each including an elastic wrist band for further aiding in securement of said shirt to said child's body, when inflation takes place, and a single valve is fixedly secured to one of said shoulder portions, for receiving either air, gas or fluid.

2. The combination according to claim 1, wherein said plurality of stomach muscle portions are fixedly secured to said hollow main body, and are spaced apart from each other, and a fastener is fixedly secured to the top of each of said shoulder portions, for receiving a fastener fixedly secured in each side of one end of said cape, and when said shirt is fully inflated on a child, it also provides water floatation means for the child.

* * * * *